United States Patent [19]

Marten et al.

[11] Patent Number: 4,797,127

[45] Date of Patent: Jan. 10, 1989

[54] LOW FOAMING, HIGH WEAVING EFFICIENCY POLYVINYL ALCOHOL SIZE COMPOSITION

[75] Inventors: Finn L. Marten, Macungie; Amir Famili, Schnecksville, both of Pa.

[73] Assignee: Air Products and Chemicals, Inc., Allentown, Pa.

[21] Appl. No.: 171,206

[22] Filed: Mar. 17, 1988

Related U.S. Application Data

[63] Continuation of Ser. No. 785,940, Oct. 9, 1985, abandoned.

[51] Int. Cl.[4] ..... C08L 5/00

[52] U.S. Cl. ..... 8/115.6; 428/295; 428/395; 252/8.6

[58] Field of Search ..... 8/115.6; 525/60, 61; 428/295, 395; 252/8.6

[56] References Cited

U.S. PATENT DOCUMENTS

| | | | |
|---|---|---|---|
| 2,277,788 | 3/1942 | Shipp et al. | 524/99 |
| 3,461,090 | 8/1943 | Haynes et al. | 260/17.4 |
| 3,598,883 | 8/1971 | Nakamura | 260/874 |
| 3,634,295 | 1/1972 | Dunlap et al. | 260/29.6 |
| 3,635,827 | 1/1972 | Jakobi | 252/358 |
| 3,689,469 | 9/1972 | Inskip | 525/60 |
| 3,804,785 | 4/1974 | Hijiya et al. | 260/17.4 |
| 4,222,922 | 9/1980 | Rees | 260/29.6 |
| 4,251,403 | 2/1981 | Rees | 260/17.4 |
| 4,309,510 | 1/1982 | Kleber | 525/6 |
| 4,383,063 | 5/1983 | Rees | 524/91 |
| 4,389,506 | 6/1983 | Hassall, Jr. | 524/377 |
| 4,399,245 | 8/1983 | Kleber et al. | 524/108 |
| 4,428,751 | 1/1985 | Via | 8/477 |
| 4,501,589 | 2/1985 | Oschatz | 8/495 |
| 4,640,946 | 2/1987 | Vassallo | 8/115.6 |

FOREIGN PATENT DOCUMENTS

| | | |
|---|---|---|
| 47-45634 | 11/1972 | Japan . |
| 7021887 | 11/1972 | Japan . |
| 7135972 | 4/1974 | Japan . |

OTHER PUBLICATIONS

Japan-10 Patent Gazette Publn. #47-45634 (72-45634), 11/17/72.

South Africa Publn. #712671.

*Primary Examiner*—Paul Lieberman

*Assistant Examiner*—John F. McNally

*Attorney, Agent, or Firm*—Michael Leach; William F. Marsh; James C. Simmons

[57] ABSTRACT

An aqueous size composition for cotton-containing textile yarn comprising in an aqueous solution (a) 100 parts polyvinyl alcohol (b) 2-15 parts hydrophobic waxy material (c) 0.2-5 parts ethylene oxide-propylene oxide surfactant which has a surface tension between about 37 and 48 dynes/cm as a 0.1% aqueous solution at 25° C., and a foaming number less than about 20 (ml foam/g solution)° F. as a 7% aqueous polyvinyl alcohol solution containing 11.4 parts hydrogenated tallow wax and 2 parts surfactant per 100 parts polyvinyl alcohol.

14 Claims, No Drawings

LOW FOAMING, HIGH WEAVING EFFICIENCY POLYVINYL ALCOHOL SIZE COMPOSITION

This is a continuation of co-pending application Ser. No. 06/785,940 filed on Oct. 9, 1985, now abandoned.

TECHNICAL FIELD

The invention relates to sizing textile yarn with aqueous polyvinyl alcohol compositions.

BACKGRDUND OF THE INVENTION

Sizing of textile fibers with polyvinyl alcohol (PVOH) is well known in the art. PVOH with a degree of hydrolysis in the range of 87 to 100 mole % has proven effective in practice as a sizing agent. However, foaming problems during sizing are observed whenever the degree of hydrolysis is below 99% and such problems increase with decreasing hydrolysis level. The presence of foam leads to uneven sizing with the result being a decrease in weaving efficiency. Foaming can be eliminated through the use Df superhydrolyzed PVOH (degree of hydrolysis 99–100%) or by the use of defoamers.

The use of superhydrolyzed PVOH in sizing operations, however, imparts other problems such as brittleness of the sizing film which in turn leads to excessive shedding and reduced weaving efficiency. The film properties and adhesion to the fibers can be increased through the addition of polyacrylates, polyesters, polyglycerols and the like.

The film properties and the adhesion to the fibers of partially hydrolyzed PVOH (hydrolysis 85–96 mole %) are superior to those exhibited by superhydrolyzed PVOH. Further, the desizing can be accomplished at a lower temperature, due to decreased crystallinity of the PVOH, leading to an energy savings. Foaming during the sizing operation, however, has to a great extent prevented partially hydrolyzed PVOH grades from penetrating the sizing market despite the above advantages.

The foaming of partially hydrolyzed PVOH can, in many operations, be successfully overcome through the addition of defoamers such as Colloid 694, 693 or 513, Drew Y-281, Nopco NXZ L and Foammaster VL defoamers or Pluronic L61 ethylene oxide-propylene oxide adduct.

However, the presence of a hydrophobic waxy material, such as hydrogenated tallow wax, which is used extensively in the sizing of textile fibers, will have a pronounced and detrimental effect on the performance of the above-mentioned defoamers. The presence of the hydrogenated tallow wax is required in most sizing compositions in order to impart lubricity during weaving and to lessen sticking to the drying cans. Thus, the foaming problem has, to a great extent, excluded PVOH products having a lower degree of hydrolysis from use in sizing compositions despite the mentioned advantages.

Japanese Patent Publication No. 47-45634 discloses a method for warp sizing polyamide synthetic fiber which comprises treating synthetic polyamide fiber with a warp-sizing composition comprising PVOH, a highly hydroscopic anionic surfactant and a nonionic surfactant which is low-foaming polypropylene glycol-ethylene oxide adduct and/or monoester thereof. Example 1 (test 2) shows, in the absence of the anionic component, there is desizing in the weaving operation.

U.S. Pat. No. 4,389,506 discloses a process for the preparation of a substantially dust-free PVOH powder comprising contacting the PVOH with about 0.5 to 4% polyglycol. This document states that block copolymers containing the constituents of polyethylene glycol with propylene oxide in which the oxyethylene content predominates (more than 50%) are, to a lesser extent, suitable as long as the end-use properties of the PVOH are not adversely affected. Composition B in Example I shows PVOH plus 1% Pluronic F98 surfactant.

U.S. Pat. No. 4,428,751 discloses a process for the wet processing of textile materials which comprises applying to the textile material an aqueous textile-treating liquor containing a textile-treating component in an amount sufficient to provide a desired effect on the textile material, and further containing in an amount sufficient to provide foam control properties, a foam control agent of the formula

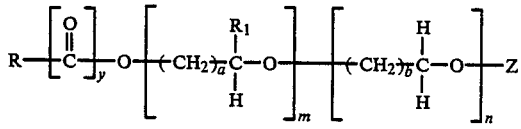

where y is 0 or 1; m and n are both independently an integer from 0 to 30 with the proviso that the sum of y+m+n must be at least 1; a and b are independently an integer from 1 to 7; R is a $C_1$–$C_{40}$ aliphatic group; $R_1$ is a $C_1$–$C_{16}$ alkyl group, a $C_1$–$C_7$ alkoxy group or a $C_3$–$C_8$ alkoxyalkyl group; and Z is hydrogen, halogen, phosphate or phosphite.

South African Pat. No. 712671 discloses a jute sizing composition which comprises a dilute aqueous solution of PVOH which has been hydrolyzed to at least about 85% and a water soluble glycol selected from the group consisting of polyethylene glycol and polypropylene glycol.

U.S. Pat. No. 3,634,295 discloses a sizing composition for man-made yarns comprising a PVOH and a polyacrylic acid.

U.S. Pat. No. 3,804,785 discloses aqueous solutions of PVOH containing amylose and/or amylitol of low molecular weight for sizing paper and textile fibers.

U.S. Pat. No. 4,222,922 discloses a warp size for filament yarn consisting essentially of PVOH, alkylphenoxy (or cresoxy) ethoxyethyl dimethylbenzyl ammonium chloride and a plasticizer such as glycerol or urea.

U.S. Pat. No. 4,251,403 discloses a warp size for filament yarn consisting essentially of PVOH, urea and mono- and di-saccharides, such as sucrose.

U.S. Pat. No. 4,309,510 discloses a sizing composition consisting of a PVOH and 1–30 wt % of an amine oxide.

U.S. Pat. No. 4,383,063 discloses a PVOH based sizing solution containing a small amount of a quaternary (e.g., dialkyldimethyl) ammonium salt or quaternary imidazolinium salt additives.

U.S. Pat. No. 4,399,245 discloses a sizing composition consisting substantially of PVOH and polyglycerol.

SUMMARY OF THE INVENTION

The present invention provides a sizing composition consisting essentially of (a) 100 parts PVOH, (b) 2 to 15 parts hydrophobic waxy material, and (c) 0.2 to 5 parts ethylene oxide-propylene oxide surfactant having a surface tension between about 37 and 48 dynes/cm at 25° C. in a 0.1% water solution and a foaming number less than about 20 (ml foam °F./g solution) as 7% aqueous PVOH solution containing 11.4 parts hydrogenated tallow wax and 2 parts surfactant per 100 parts PVOH.

The sizing composition is utilized as an aqueous solution at about 1 to 20 wt %.

The addition of certain ethylene oxide-propylene oxide surfactants according to the invention to a sizing composition comprising a PVOH and a hydrophobic waxy material advantageously provides surprisingly low foam during the sizing operation, low shedding during the weaving operation and high weaving efficiency. These advantages are obtained when the sizing composition is used for cotton-containing textile yarn. No significant advantages are observed for all polyester or all polyamide synthetic textile yarn.

It is believed that the presence of the ethylene oxide-propylene oxide surfactant provides improved encapsulation and penetration of the yarns. Thus a size film having greater strength and lower shedding due to increased adhesion and uniformity is achieved.

Another embodiment of the invention is a textile process for treating cotton-containing yarn which comprises passing the yarn through an aqueous size solution according to the invention, removing excess size solution from the yarn, drying the sized yarn, splitting the yarn, winding the yarn, weaving the yarn and removing the size from the woven product.

DETAILED DESCRIPTION OF THE INVENTION

According to the invention the sizing composition consists essentially of the following components:

(a) a PVOH which preferably is 85–99+ mole % hydrolyzed and has a viscosity ranging from about 3 to about 60 mPas (cps) as a 4% aqueous solution at 20° C., (b) 2–15 wt % hydrophobic waxy material, based on PVOH, and (c) 0.2–5 wt % surfactant, based on PVOH, which surfactant is an ethylene oxide-propylene oxide adduct and has a surface tension between 37 and 48 dynes/cm measured at 25° C. in a 0.1% aqueous solution and a foaming number less than about 20 (ml foam °F./g solution) as 7% aqueous PVOH solution containing 11.4 parts hydrogenated tallow wax and 2 parts surfactant per 100 parts PVOH.

Suitable polyvinyl alcohols for use in the sizing composition include fully hydrolyzed PVOH's (98–99+mole % hydrolyzed) such as produced by methanolysis of polyvinyl acetate homopolymers and copolymers of vinyl alcohol and methyl methacrylate at least 99.5 mole % hydrolyzed consisting of 94–98% vinyl alcohol and 2–6 wt % methyl methacrylate as disclosed in U.S. Pat. No. 3,689,469. Suitable partially hydrolyzed PVOH's are those that are about 85 to 97 mole % hydrolyzed although material which is at least about 78 mole % hydrolyzed may also be used.

The hydrophobic waxy material used in the size composition can be any waxy substance typically used in the art to impart lubricity to the textile yarn during weaving and includes such materials as hydrogenated tallow wax, fatty acids or salts thereof, polyol waxes and the like. The amount of hydrophobic waxy material in the size composition ranges from 2–15 wt %, preferably 5–12 wt %, based on PVOH.

The ethylene oxide-propylene oxide surfactant is used preferably in an amount ranging from 0.5 to 5 wt %, and most desirably 1–3 wt %, based on polyvinyl alcohol. With some surfactants the foaming problem reappears if the surfactant level in the sizing composition is increased above about 3 wt %. Illustrative of suitable ethylene oxide-propylene oxide surfactants are those having the following formulas:

$$HO(C_2H_4O)_y(C_3H_6O)_x(C_2H_4O)_yH \qquad \text{I}$$

and $$\begin{array}{ccc} H(OC_2H_4)_y(OC_3H_6)_x & & (C_3H_6O)_x(C_2H_4O)_yH \\ & NCH_2CH_2N & \\ H(OC_2H_4)_y(OC_3H_6)_x & & (C_3H_6O)_x(C_2H_4O)_yH \end{array} \qquad \text{II}$$

where x and y are integers and are selected such that the oxypropylene groups constitute at least 900 molecular weight of the compound and the oxyethylene groups constitute 20 to 90 wt % of the compound. Surfactants according to the first formula are condensates of ethylene oxide with hydrophobic bases formed by condensing propylene oxide with propylene glycol. Such surfactants are sold commercially under the trademark Pluronic by BASF Wyandotte Corp. Surfactants according to the second formula are compounds formed by the addition of propylene oxide to ethylenediamine followed by the addition of ethylene oxide and are sold commercially under the trademark Tetronic by BASF Wyandotte Corp.

In addition, ethylene oxide-propylene oxide surfactants according to the above formulas in which the ethylene oxide and propylene oxide units are reversed have also been found suitable. Such reverse ethylene oxide-propylene oxide surfactants are also available from BASF Wyandotte Corp.

Monoesters of the above surfactants with $C_1$–$C_6$ carboxylic acids are contemplated as being functional, or operative, equivalents in this invention.

While those ethylene oxide-propylene oxide surfactants having a surface tension between 37 and 48 dynes/cm and a foaming number less than about 20 afford unexpectedly low foam sizing operation when used in an aqueous PVOH-wax size composition, it is preferred to use such surfactants having a foaming number less than 15 and most preferably below 10 because foam control is superior.

The following technique is used to determine the foaming number, i.e. the degree of foaming of an aqueous size solution:

The aqueous size solution contains 7% PVOH (based on water) having a DP of about 1700 and a degree of hydrolysis of about 87–89 mole %, 11.4% hydrogenated tallow wax (based on PVOH), and 2% ethylene oxide-propylene oxide (EO-PO) surfactant (based on PVOH).

The aqueous size solution (400 g) is placed in a 1 liter beaker, equilibrated at 100 rpm at the desired temperature and stirred at 1000 rpm for one hour using a 2.25 inch 45° pitched turbine placed in the center of the beaker 0.75 inch below the liquid surface. The mixture is then transferred to a 1 liter graduated cylinder and the weight as well as volume of the foamed size is recorded. The foaming is calculated according to the following formulas:

$$\text{Foam Density (g/ml)} = \frac{\text{weight } PVOH \text{ size solution (g)}}{\text{foam volume (ml)}}$$

$$\text{ml foam/g} = \frac{\text{(1-Foam Density)}}{\text{Foam Density}}$$

The foaming is measured at 140° F., 150° F., 170° F. and 190° F. thus covering the normal operating range of a sizing operation. When ml foam/g is plotted against temperature, the area below the curve from 140° to 190° F. is the foaming number, the measure of the foaming behavior of the size solution. The smaller the area, the lower the foaming number, and the lower the foaming tendency.

The PVOH-containing size composition of the present invention will be used as an aqueous solution in the textile industry. Thus an aqueous size solution will generally have a solids content from about 1 to about 20 wt %, preferably about 5 to 18 wt %, or 2 to 7 wt % if the yarn is double-dipped.

Any means and method for physically mixing the components in an aqueous medium can be used. Preferably the waxy material is added to the cooking kettle containing water prior to or approximately simultaneously with the addition of the PVOH and the ethylene oxide-propylene oxide surfactant. The surfactant may be physically mixed with the PVOH or sprayed on the PVOH as a liquid or solution to yield a solids product for subsequent dissolving in water.

Starch is often blended with PVOH in sizing compositions. Similarly, the present size composition can also contain common textile warp size starch. The sizing composition can also be modified with other materials for specific textile uses as is customary in sizing applications.

The defoaming action of the defined ethylene oxide-propylene oxide surfactants surprisingly cannot be predicted from the dynamic foam height of the pure material. Also, contrary to the teaching of the ethylene oxide-propylene oxide surfactant literature, products having a high content of propylene oxide in most cases show poor defoaming characteristics in the above size formulation.

The temperature of the aqueous size solution should be between 55° C. (131° F.) and 93° C. (200° F.), preferably between 60° C. (140° F.) and 88° C. (190° F.) in the sizing operation. Either single or multiple size boxes containing the aqueous size solution may be used as is well known in the art. After removal of excess size solution by passage between squeeze rolls, the sized yarn is dried by contact with multiple drying cans heated to a temperature of about 100° to 175° C., split by stationary lease rods, and wound as a weaving beam. The slashing operation is conducted at speeds of 10 to 100 meters/min.

Essential properties of the size composition include absence of foaming in the size box, no build-up on drying cans, clean splitting at the lease bars without breakage of ends or filaments, little or no shedding and easy separation of the sized yarns when entering into the loom harness.

Weaving may be performed with conventional shuttle looms, air-jet looms, rapier looms or shuttleless weaving machines. Essential characteristics are production of first class cloth, loom efficiency, and absence of loom fouling by shedding. During finishing the size is removed by scouring with hot water. The size is easily removed especially in the case of partially hydrolyzed PVOH by using a moderate water temperature of 55° to 75° C..

The use of PVOH/ethylene oxide-propylene oxide surfactant/wax size compositons according to the present invention for cotton-containing textile yarn affords low foaming during the sizing process, surprisingly high weaving efficiency and decreased shedding during weaving. Cotton-containing textile yarns include combinations of synthetic fibers such as, for example, polyesters and poplyamides, with at least 10%, preferably at least 35% cotton fibers or all-cotton yarns.

The following examples are given for the purpose of illustrating the present invention. All parts and percentages are by weight unless otherwise specified.

The temperature of the aqueous size solution should be between 55° C. (131° F.) and 93° C. (200° F.), preferably between 60° C. (140° F.) and 88° C. (190° F.) in the sizing operation. Either single or multiple size boxes containing the aqueous size solution may be used as is well known in the art. After removal of excess size solution by passage between squeeze rolls, the sized yarn is dried by contact with multiple drying cans heated to a temperature of about 100° to 175° C., split by stationary lease rods, and wound as a weaving beam. The slashing operation is conducted at speeds of 10 to 100 meters/min.

Essential properties of the size composition include absence of foaming in the size box, no build-up on drying cans, clean splitting at the lease bars without breakage of ends or filaments, little or no shedding and easy separation of the sized yarns when entering into the loom harness.

Weaving may be performed conventional shuttle looms, air-jet looms, rapier looms or shuttle-less weaving machines. Essential characteristics are production of first class cloth, loom efficiency, and absence of loom fouling by shedding. During finishing the size is removed by scouring with hot water. The size is easily removed especially in the case of partially hydrolyzed PVOH by using a moderate water temperature of 55° to 75° C.

The use of PVOH/ethylene oxide-propylene oxide surfactant/wax size compositions according to the present invention for cotton-containing textile yarn affords low foaming during the sizing process, surprisingly high weaving efficiency and decreased shedding during weaving. Cotton-containing textile yarns include combinations of synthetic fibers such as, for example, polyesters and polyamides, with at least 10%, preferably at least 35% cotton fibers or all-cotton yarns.

The following examples are given for the purpose of illustrating the o present invention. All parts and percentages are by weight unless otherwise specified.

EXAMPLE 1

This example presents the foaming numbers which were determined for a number of ethylene oxide-propylene oxide surfactants having a surface tension ranging from 33 to 50.4 dynes/cm following the previously described procedure.

Run 1 was a control using the aqueous PVOH/wax size composition without a surfactant. Runs 2–19 employed, in addition, an ethylene oxide-propylene oxide surfactant. The data is presented in Table I.

TABLE I

| Run # | EO-PO SURFACTANT | Wt. % EO | Wt. % PO | HLB | MW grams/mole | Cloud Point °C. | Surface Tension dynes/cm | Dynamic Foam Wt. mm | FOAMING Foaming Number (ml foam/gram) °F. |
|---|---|---|---|---|---|---|---|---|---|
| 1 | — | — | — | — | — | — | — | — | 38.5 |
| 2 | P-17R1 | 10 | 90 | 2.5 | 1900 | 32 | 33.0 | 5 | 30.8 |
| 3 | P-L122 | 20 | 80 | 4.0 | 5000 | 19 | 33.0 | 15 | 33.5 |
| 4 | P-L92 | 20 | 80 | 5.5 | 3650 | 26 | 35.9 | 25 | 37.0 |
| 5 | P-25R2 | 20 | 80 | 3.5 | 3100 | 29 | 37.5 | <5 | 11.3 |
| 6 | P-31R2 | 20 | 80 | 2.9 | 3300 | 30 | 38.9 | <5 | 11.5 |
| 7 | P-25R4 | 40 | 60 | 6.0 | 3600 | 40 | 40.9 | 70 | 2.5 |
| 8 | P-L108 | 80 | 20 | 27.0 | 14000 | >100 | 41.2 | >600 | 4.3 |
| 9 | T-90R4 | 40 | 60 | 7.1 | 7,240 | 43 | 42.7 | 50 | 8.7 |
| 10 | P-F98 | 80 | 20 | 27.5 | 13,000 | >100 | 43.0 | >600 | 11.9 |
| 11 | T-150R8 | 80 | 20 | 11.2 | 20400 | 38 | 44.4 | 50 | 4.8 |
| 12 | P-25R8 | 80 | 20 | 12.1 | 8550 | 45 | 46.1 | 50 | 7.0 |
| 13 | P-L42 | 20 | 80 | 8.0 | 1630 | 37 | 46.5 | 10 | 22.8 |
| 14 | T-110R7 | 70 | 30 | 9.5 | 13200 | 52 | 46.5 | 45 | 3.8 |
| 15 | P-L31 | 10 | 90 | 4.5 | 1100 | 37 | 46.9 | 18 | 17.0 |
| 16 | P-17R8 | 80 | 20 | 13.4 | 7000 | 81 | 47.3 | 45 | 23.4 |
| 17 | P-F68 | 80 | 20 | 29.0 | 8,400 | >100 | 50.3 | >600 | 34.2 |
| 18 | T-90R8 | 80 | 20 | 12.9 | 18700 | 81 | 50.4 | 30 | 32.4 |
| 19 | P-L61 | 10 | 90 | 3.0 | 2000 | 24 | —(1) | 10 | 35.8 |

P = Pluronic EO-PO surfactant
T = Tetronic EO-PO surfactant
(1)Not water soluble.

The data in Table 1 demonstrates the importance of surface tension and foaming number for achieving foam control. It can be seen that Runs 5–15 (Except Run 13) in which the surface tensions range from about 37.5–46.9 dynes/cm provided surprising defoaming conrrol. Run 13 in which the surfactant had a surface tension of 46.5 dynes/cm and a foaming number greater than 20 demonstrated only slight defoaming control.

EXAMPLE 2

In Runs 20–23 a technique similar to that used in Example 1 was employed in order to define the foaming sensitivity of a size solution with respect to total amount of hydrogenated tallow wax present. The aqueous size composition employed contained 7% PVOH (degree of polymerization of about 1700; degree of hydrolysis about 87–89 mole %), 2% ethylene oxide-propylene oxide surfactant used in Run 12 of Example 1 and a variable amount of hydrogenated tallow wax.

TABLE II

| RUN | Tallow Wax Wt. % on PVOH | Foaming Area (ml Foam/gram) °F. |
|---|---|---|
| 20 | 11.4 | 7.0 |
| 21 | 9.0 | 5.4 |
| 22 | 6.0 | 7.1 |
| 23 | 3.0 | 12.7 |

The results in Table II demonstrate that the ethylene oxide-propylene oxide surfactant yielded excellent defoaming in the preferred range of wax addition.

EXAMPLE 3

A size solution was prepared by slurrying 91 kg PVOH (degree of polymerization about 1700; degree of hydrolysis about 87–89 mole %), 24 pounds of hydrogenated tallow wax, and 1.8 kg of ethylene oxide-propylene oxide surfactant into 795 kg of water. A solution was formed by injecting steam into the aqueous mixture under stirring until the temperature of 93° C. was reached. The final solution solids was 8%. This size composition was used to size 65/35 polyester/cotton spun yarn with a conventional commercial slasher. The yarn speed during slashing was 87 yards per minute, temperature 77° C. (170° F.) and squeeze cool pressure 15 psi. Weaving of the slashed yarns was accomplished using a Sulzer air jet loom. The obtained weaving results are shown in Table III. Run 24 was a control which contained no surfactant. Run 25 used an ethylene oxide-propylene oxide surfactant with a surface tension and foaming number within the defined limits of the invention while Run 26 used a surfactant outside the limits.

TABLE III

| Run | EO-PO Surfactant | Surface Tension dynes/cm | Foaming Number | Wt. % EO | MW grams/mole | Size Add-on Wt % | Yarn Characteristics Penetration % | Degree of encapsulation Degrees | Warp Stops 100000 picks | Weaving Efficiency % |
|---|---|---|---|---|---|---|---|---|---|---|
| 24 | — | — | — | — | — | 13.9 | 20 | 333 | 21.3 | 85.9 |
| 25 | P-25R8 | 46.1 | 7.0 | 80 | 8550 | 13.4 | 22 | 353 | 8.5 | 96.8 |
| 26 | T-90R8 | 50.4 | 32.4 | 80 | 18700 | 13.4 | 14 | 324 | 19.6 | 84.9 |

It can be seen from Table III that Run 25 which used a PVOH size composition containing an ethylene oxide-propylene oxide surfactant within the scope of the invention afforded a marked increase in weaving efficiency in contrast to Run 26 in which the surfactant had a surface tension of 50.4 dynes/cm and a foaming number of 32.4, outside the range according to the invention.

The ethylene oxide-propylene oxide surfactants which have a surface tension between about 37 and 48 dynes/cm and a foaming number less than about 20 promote the emulsification and subsequent increased interaction between the tallow wax and the PVOH solution significantly reducing the foaming. The surfactant, in addition, works as a wetting agent promoting good penetration and complete encapsulation of the yarns, thus producing a size film having greater strength and lower shedding due to increased adhesion and uniformity. The size composition according to the invention takes advantage of the excellent size properties inherent to partially hydrolyzed polyvinyl alcohols, thus permitting the elimination of additives such as polyacrylates, polyesters, polyglycerols and the like as needed in the case of fully hydrolyzed polyvinyl alcohols.

STATEMENT OF INDUSTRIAL APPLICATION

The invention provides an aqueous polyvinyl alcohol-containing size composition which is low foaming and affords a high weaving efficiency when used in conjunction with cotton-containing textile yarn.

We claim:

1. A sizing composition consisting essentially of
(a) 100 parts by weight 85–97 mole % hydrolyzed polyvinyl alcohol,
(b) 2–15 parts by weight hydrogenated tallow wax or a fatty acid,
(c) 1–3 parts by weight surfactant composition consisting essentially of an ethylene oxide-propylene oxide surfactant having a surface tension ranging from 37 to 48 dynes/cm measured at 25° C. in a 0.1% aqueous solution and a foaming number less than 10 as determined in a 7% aqueous polyvinyl alcohol solution containing 11.4 parts by weight hydrogenated tallow wax and two parts by weight surfactant per 100 parts by weight 87–89 mole % hydrolyzed polyvinyl alcohol having a DP of about 1700.

2. The sizing composition of claim 1 in which the surfactant can be represented by one of the following formulas:

$$HO(C_2H_4O)_y(C_3H_6O)_x(C_2H_4O)_yH \quad \text{I}$$

and

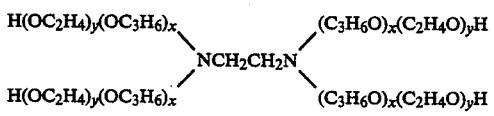

where x and Y are integers and are selected such that the oxypropylene groups constitute at least 900 molecular weight of the surfactant and the oxyethylene groups constitute 20–90 wt % of the surfactant, or the above formulas in which the ethylene oxide and propylene oxide groups are reversed.

3. An aqueous sizing composition containing from 1 to 20 wt % of the sizing composition of claim 1 remainder being water.

4. A sizing composition consisting essentially of (in parts by weight)
(a) 100 parts polyvinyl alcohol which is 85–97 mole % hydrolyzed and has a viscosity of about 3 to 60 cps as a 4% aqueous solution at 20° C.,
(b) 5–12 parts hydrogenated tallow wax,
(c) 1–3 parts surfactant composition consisting essentially of an ethylene oxide-propylene oxide surfactant having a surface tension ranging from 37 to 48 dynes/cm measured at 25° C. in a 0.1% aqueous solution and a foaming number less than about 10 as determined in a 7% aqueous solution containing 11.4 parts hydrogenated tallow wax and 2 parts surfactant per 100 parts 87–89 mole % hydrolyzed polyvinyl alcohol having a DP of about 1700.

5. The sizing composition of claim 4 in which the surfactant can be represented by one of the following formulas:

$$HO(C_2H_4O)_y(C_3H_6O)_x(C_2H_4O)_yH \quad \text{I}$$

and

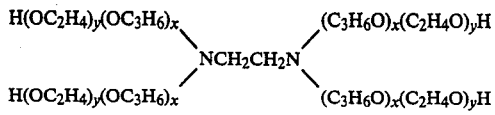

where x and y are integers and are selected such that the oxypropylene groups constitute at least 900 molecular weight of the surfactant and the oxyethylene groups constitute 20–90 wt % of the surfactant, or the above formulas in which the ethylene oxide and propylene oxide groups are reversed.

6. An aqueous sizing composition containing from 1 to 20 wt % of the sizing composition of claim 5 remainder being water.

7. A sizing composition consisting essentially of (in parts by weight):
(a) 100 parts polyvinyl alcohol which is 87–89 mole % hydrolyzed and has a viscosity of about 3–60 cps as a 4% aqueous solution at 20° C.,
(b) 5–12 parts hydrogenated tallow wax,
(c) 1–3 parts surfactant composition consisting essentially of an ethylene oxide-propylene oxide surfactant having a surface tension ranging from 37 to 48 dynes/cm measured at 25° C. in a 0.1% aqueous solution and a foaming number less than about 10 as determined in aqueous polyvinyl alcohol solution containing 11.4 parts dydrogenated tallow wax and 2 parts surfactant per 100 parts 87–89 mole % hydrolyzed polyvinyl alcohol having a DP of about 1700.

8. An aqueous sizing composition containing from 1 to 20 wt % of the sizing composition of claim 7 remainder being water.

9. A textile process which comprises passing a cotton-containing textile yarn through an aqueous size composition of claim 3, removing excess size solution from the yarn, drying the sized yarn, splitting the yarn, winding as a weaving beam, weaving the yarn and removing the size from the woven product by scouring with hot water.

10. A textile process which comprises passing a cotton-containing textile yarn through an aqueous size composition of claim 6, removing excess size solution from the yarn, drying the sized yarn, splitting the yarn, winding as a weaving beam, weaving the yarn and removing the size from the woven product by scouring with hot water.

11. A textile process which comprises passing a cotton-containing textile yarn through an aqueous size composition of claim 8, removing excess size solution from the yarn, drying the sized yarn, splitting the yarn, winding as a weaving beam, weaving the yarn and removing the size from the woven product by scouring with hot water.

12. A composite comprising a coating of a size composition of claim 1 on a cotton-containing textile yarn.

13. A composite comprising a coating of a size composition of claim 5 on a cotton-containing textile yarn.

14. A composite comprising a coating of a size composition of claim 7 on a cotton-containing textile yarn.

* * * * *

UNITED STATES PATENT AND TRADEMARK OFFICE

CERTIFICATE OF CORRECTION

PATENT NO. : 4,797,127

DATED : 10 January 1989

INVENTOR(S) : Finn L. Marten and Amir Famili

It is certified that error appears in the above-identified patent and that said Letters Patent is hereby corrected as shown below:

Column 9, Line 45
Delete "Y" and substitute therefor -y-

Signed and Sealed this

Twenty-sixth Day of September, 1989

*Attest:*

DONALD J. QUIGG

*Attesting Officer*

*Commissioner of Patents and Trademarks*